United States Patent [19]

Sherman et al.

[11] 4,257,713

[45] Mar. 24, 1981

[54] CONICAL PEN

[75] Inventors: Alan E. Sherman; Harold E. Koeln, both of St. Louis County, Mo.

[73] Assignee: Penn Corporation, Princeton, N.J.

[21] Appl. No.: 944,765

[22] Filed: Sep. 22, 1978

[51] Int. Cl.[3] ..... B43K 23/04

[52] U.S. Cl. ..... 401/88; 401/131; 401/195; 401/209; D19/45; D19/51

[58] Field of Search ..... 401/6, 99, 49, 89, 52, 401/54, 88, 55, 131, 29, 192, 7, 194, 85, 195, 208, 292, 209, 31, 95, 90, 91, 86, 87, 68–78, 96, 98; 40/334, 335, 905; D19/41–51; 229/4.5

[56] References Cited

U.S. PATENT DOCUMENTS

| | | | |
|---|---|---|---|
| D. 59,052 | 9/1921 | Worthy et al. | D19/42 |
| 140,842 | 7/1873 | Rembert | 401/52 |
| 1,391,556 | 9/1921 | Manuel | 401/7 |
| 1,898,112 | 2/1933 | Wright | 229/4.5 |
| 1,966,207 | 7/1934 | Lang | 401/85 X |
| 2,134,427 | 10/1938 | Biderman | 229/4.5 X |
| 2,180,560 | 11/1939 | Stempel | 401/88 |
| 2,385,329 | 9/1945 | Buchanan | 401/85 X |
| 2,480,740 | 8/1949 | Johnson | 401/88 |
| 2,525,229 | 10/1950 | Lynn | 401/85 X |
| 2,865,334 | 12/1958 | Radzinsky | 401/209 |
| 3,250,033 | 5/1966 | Siegel | 40/334 |
| 3,420,611 | 1/1969 | Towns | 401/99 X |

FOREIGN PATENT DOCUMENTS

| | | | |
|---|---|---|---|
| 382737 | 11/1922 | Fed. Rep. of Germany | 401/31 |
| 1137058 | 5/1957 | France | 40/334 |
| 8790 | of 1889 | United Kingdom | 401/95 |

*Primary Examiner*—Steven A. Bratlie

*Attorney, Agent, or Firm*—John D. Pope, III

[57] ABSTRACT

A writing instrument in a conical configuration is provided which is less easily misplaced and which can be placed in a position of vertical stability if desired. The surface areas of the writing instrument are well adapted to display decorative or promotional indicia of a number of different types, or a combination of both.

7 Claims, 5 Drawing Figures

CONICAL PEN

According to the present invention a conical pen is provided which can be imprinted or decorated in a wide variety of ways.

Writing instruments of many types have been provided in the past but for the most part they have followed a conventional configuration adapting them to be carried easily. This very portability has led to an increased danger of loss through accident or misplacement.

The present invention is directed to a writing instrument of novel configuration which presents improved visibility thereby decreasing chances for loss of misplacement. In addition, the instrument is well adapted to display decorative motifs or advertising legends or both so that it can also perform a decorative or promotional function depending upon the imprinting or decoration applied thereto.

Among the objects of the present invention are the provision of a writing instrument which is adapted to become a standard desk accessory for a user and thereby generate greater interest in the user assuring its continued presence in a selected location. Another object is the provision of a writing instrument having a substantial area available for artistic embellishment or for promotional indicia. Another object is the provision of a writing instrument which is not easily mislaid, is less easily dislodged from slanting surfaces and is readily manufactured at low cost for wide-spread distribution. Other objects and features will be in part apparent and in part pointed out hereinafter.

The invention accordingly comprises the constructions hereinafter described, the scope of the invention being indicated in the following claims.

In the accompanying drawings in which one of various possible embodiments of the invention is illustrated, FIG. 1 is a perspective view of the writing instrument of the present invention;

Corresponding reference characters indicate corresponding parts throughout the several views of the drawings.

Figure 1:
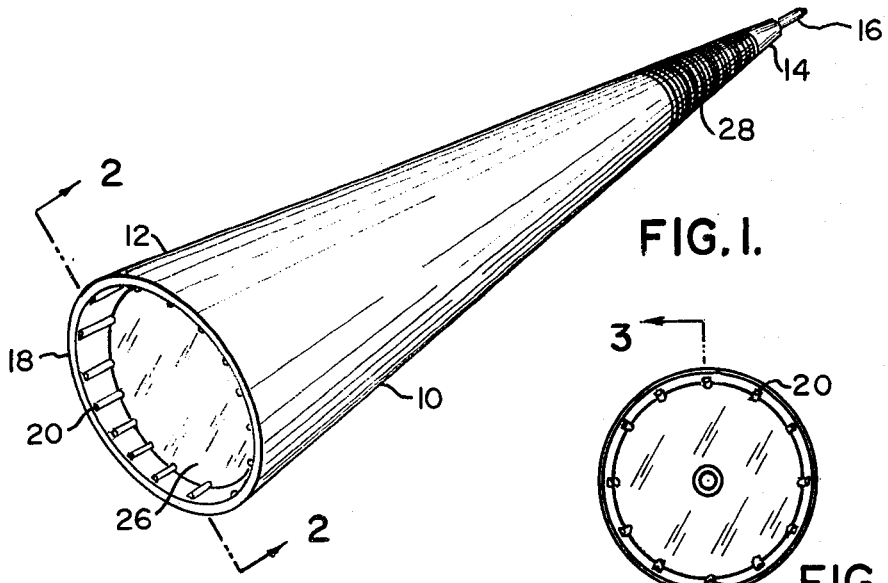
Figure 2:
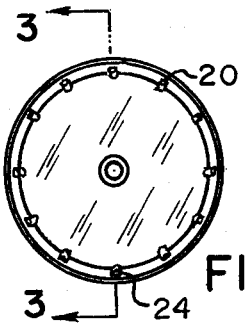
FIG. 2 is a sectional view taken on line 2—2 on FIG. 1.
Figure 3:
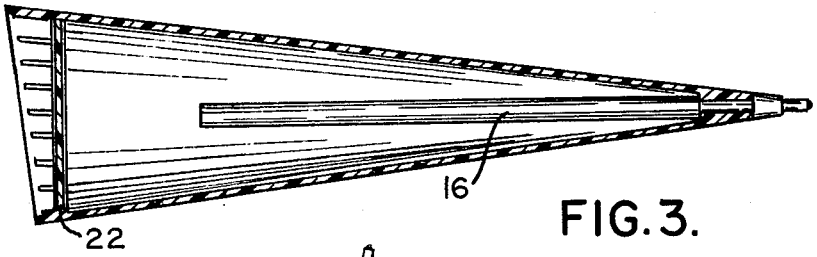
FIG. 3 is a sectional view taken on the line 3—3 on FIG. 2.

The writing instrument of the present invention includes a tapering case 10 which may be constructed of a suitable plastic or other customary material for the fabrication of writing instruments. Case 10 has a large end 12 and a small end 14. Located within the case is a writing mechanism 16 which may be a ball point pen refill mechanism of the usual type. This refill is positioned in case 10 so that it projects through small end 14.

Large end 12 terminates in a generally circular opening 18 around which are positioned ridges 20 which extend from a generally circular ring 22 to adjacent opening 18. One ridge 24 is formed to extend through ring 22 as a key for emplacement of a wall 26 which closes the large end 12 of case 10. Wall 26 is press-fitted during manufacture of the instrument into its location in case 10 by means of key ridge 24 and notch 30.

Figure 4:
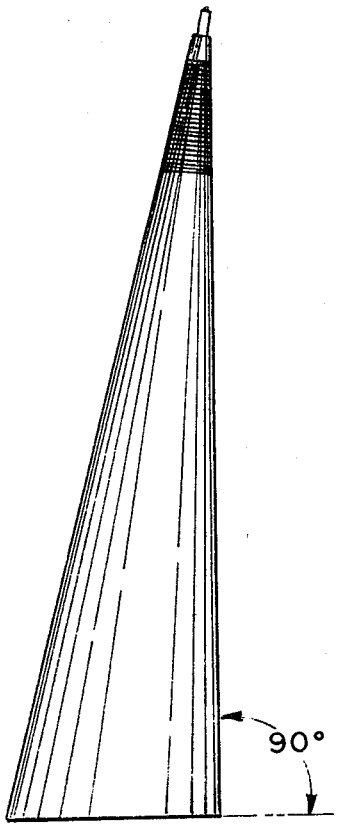
FIG. 4 is a vertical plan showing the instrument resting on a flat surface.
Figure 5:
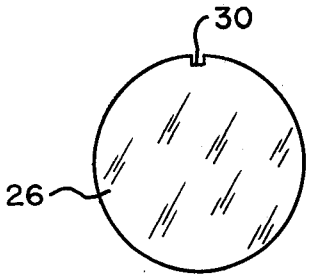
FIG. 5 is a plan of the end wall.

Opening 18 and the configuration of case 10 are such that the writing instrument will rest securely on end 12 when it is placed on a flat surface. When the instrument is in this position (see FIG. 4) a line from one point on circular opening 18 to small end 14 of case 10 is approximately perpendicular to the surface upon which the writing instrument is resting. In this embodiment the central axis is about 5° out of perpendicular to wall 26 when wall 26 is interlocked in place in case during manufacture. If this angle is at least about 5° out of perpendicular to wall 26 it increases the visual impact of the imprinting or decoration applied thereto.

The writing instrument of the present invention utilizes a case which is not only of a different configuration from, but is substantially larger than, the case for the customary writing instrument. This case provides a surface to which can be applied decorative motifs or promotional indicia so that the writing instrument becomes either a decorative source for a desk or table or it performs a valuable advertising function. The decorative motifs can be applied not only to the exterior of case 10 but also to the exterior of wall 26 which closes large end 12 of case 10. Because of the configuration of the instrument, when it is placed in a pen holder the decorative motif on all parts thereof, including wall 26, is seen by a viewer. The same is true when instead of a decorative motif, advertising indicia is applied thereto.

The configuration of the writing instrument is an important factor whether or not a pen holder is employed. This configuration prevents the instrument rolling off inclined surfaces such as drawing boards and slant top desks and counters. This obviates the necessity for a base or ledge in such environments to assure the ready availability of the instrument.

If the case 10 is constructed of transparent material decorations or indicia can be applied internally of case 10 and be viewed through the case in a manner similar to the way in which such motifs or indicia are viewed when imprinted on the outside of an opaque case.

Case 10 is preferably formed with a series of projections 28 adjacent small end 14 to facilitate grasping the instrument by a user in order to write with it.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A pen comprising a case and writing mechanism in said case, said case being formed as a shell having one end substantially larger than the other with the writing mechanism located internally to project from the smaller end, said case tapering from the larger end to the small end about a central axis, said larger end terminating in a generally circular end, one point on which locates the case so that when the generally circular end is resting on a surface, a line through said point which connects said point to the smaller end of the case is approximately perpendicular to said surface, the larger end being closed with a wall, said wall at the larger end interlocking with the case to position the wall in the case.

2. A pen according to claim 1 in which the writing mechanism is a ball point mechanism.

3. A pen according to claim 1 in which the central axis of the case is out of perpendicular to the wall which closes the larger end of the case.

4. A pen according to claim 1 in which a ridge interlocks the wall to the case and at least one other ridge interconnects the larger end and a generally circular ring.

5. A pen according to claim 4 in which the interlocking ridge and the generally circular ring position the wall in the case.

6. A pen comprising a shell in the form of a cone revolved around a central axis and having a smaller end and a larger end, said larger end in the shape of an ellipse and being perpendicular to the shell at one point, a writing mechanism in said shell on said central axis and extending out of said smaller end, a wall recessed into the larger end and interlocking with the interior walls of said shell closing said larger end, and a plurality of longitudinal ridges on the interior walls of said shell extending from said larger end and terminating abuttingly against said wall for holding said wall in said shell.

7. A pen according to claim 6 in which said wall is out of perpendicular to said central axis.

* * * * *